US008701784B2

(12) United States Patent
Huseman et al.

(10) Patent No.: US 8,701,784 B2
(45) Date of Patent: Apr. 22, 2014

(54) TONGS TRIGGERING METHOD

(76) Inventors: Jonathan V. Huseman, Midland, TX (US); Kasia L. Robnett, Midland, TX (US); Frederic M. Newman, Midland, TX (US)

( * ) Notice: Subject to any disclaimer, the term of this patent is extended or adjusted under 35 U.S.C. 154(b) by 495 days.

(21) Appl. No.: 13/135,425

(22) Filed: Jul. 5, 2011

(65) Prior Publication Data

US 2013/0008644 A1 Jan. 10, 2013

(51) Int. Cl.
*E21B 19/20* (2006.01)
*E21B 19/16* (2006.01)

(52) U.S. Cl.
USPC ..... 166/377; 166/77.51; 166/379; 175/52; 702/9

(58) Field of Classification Search
CPC ..... E21B 19/20; E21B 19/165; E21B 19/14
USPC ..... 166/77.51, 377, 379; 175/52; 702/9
See application file for complete search history.

(56) References Cited

U.S. PATENT DOCUMENTS 4,110,688 A * 8/1978 Bailey ..... 324/207.24
4,119,837 A 10/1978 Sheldon et al.
4,249,831 A 2/1981 Sable et al.
4,269,554 A 5/1981 Jackson
4,403,666 A 9/1983 Willis
4,468,959 A 9/1984 Roberts
4,481,714 A 11/1984 Nelson
4,591,006 A 5/1986 Hutchison et al.
4,604,724 A 8/1986 Shaginian et al.
4,621,974 A * 11/1986 Krueger ..... 414/800
4,650,235 A 3/1987 Shaginian et al.
4,696,207 A * 9/1987 Boyadjieff ..... 81/57.34
5,062,756 A 11/1991 McArthur et al.
5,711,382 A 1/1998 Hansen et al.
5,988,299 A 11/1999 Hansen et al.
6,079,490 A 6/2000 Newman
6,688,389 B2 2/2004 Connell et al.
6,877,558 B2 4/2005 Connell et al.
6,896,056 B2 5/2005 Mendez et al.
7,001,065 B2 2/2006 Dishaw et al.
7,006,920 B2 2/2006 Newman et al.
7,158,446 B2 1/2007 Gardner et al.
7,163,335 B2 1/2007 Dishaw et al.
7,249,639 B2 7/2007 Belik
7,461,830 B2 12/2008 Newman
7,518,526 B2 4/2009 Newman
7,571,054 B2 8/2009 Newman
7,588,083 B2 9/2009 Newman
7,672,785 B2 3/2010 Newman
7,677,331 B2 3/2010 Lowe et al.
7,717,193 B2 5/2010 Egilsson et al.
7,788,054 B2 8/2010 Newman
7,878,254 B2 2/2011 Abdollahi et al.
2009/0084558 A1 4/2009 Bloom

* cited by examiner

*Primary Examiner* — Giovanna Wright
(74) *Attorney, Agent, or Firm* — www.bobharter.com; Robert J. Harter

(57) ABSTRACT

A method for controlling and coordinating the operation of a lifting device and a tongs device in removing and disassembling and/or installing and assembling a series of elongate members disposed within a wellbore involves sequentially sensing the presence of a series of joints and automatically triggering the lifting device and tongs device in response thereto. In some examples, the method senses the location of an upper joint to determine when the lifting device should begin decelerating prior to stopping the ascent of a lower joint at a target elevation. In some examples, the method includes control means for automatically skipping various joints.

20 Claims, 8 Drawing Sheets

TONGS TRIGGERING METHOD

FIELD OF THE INVENTION

The subject invention generally pertains to servicing wells for extracting oil or other fluids and more specifically pertains to triggering the actuation of tongs used for assembling and disassembling a series of elongate members such as tubing, sucker rods, sinker bars and the like.

BACKGROUND

Wells for extracting oil or other fluids typically include various assemblies of interconnected elongate members disposed within a wellbore. Some examples of such elongate members include sucker rods, sinker bars, tubing, casing pipe, etc. Occasionally, wells need to be repaired or otherwise serviced, which may involve extracting and disassembling one or more of the elongate members. Current methods for servicing wells can be slow, manually intensive, and often dangerous.

DESCRIPTION OF THE PREFERRED EMBODIMENT

Figure 1:
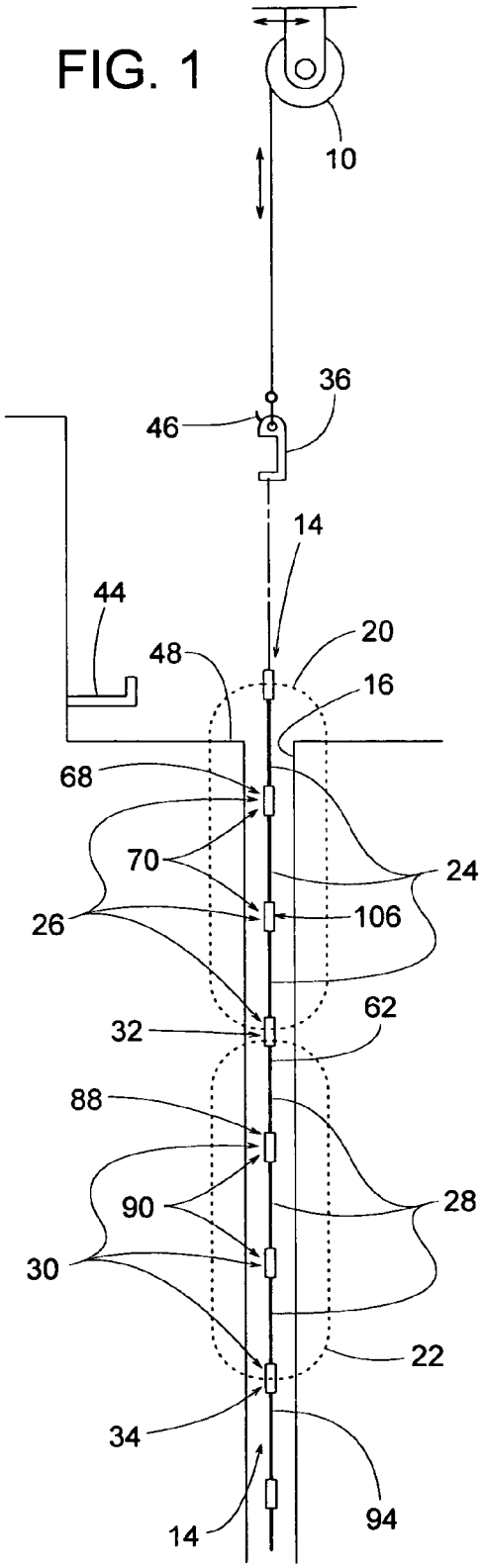
FIG. 1 is a schematic side view of an example wellbore for which an example method for automatically coordinating the operation of a lifting device and a tongs device can be applied.

FIGS. 1-15 illustrate a method for controlling and coordinating the operation of a lifting device 10 and a tongs device 12 in handling a series of elongate members 14 associated with a wellbore 16. Examples of elongate members 14 include, but are not limited to, sucker rods, sinker bars, tubing, pipe, etc. Lifting device 10 is schematically illustrated to represent any means for selectively raising and lowering the series of elongate members 14. Examples of lifting device 10 include, but are not limited to, a hoist, winch, drawworks, crane, derrick, robotic mechanism, hydraulic cylinder, rodless cylinder, frictional drive wheel, and various combinations thereof, etc.

Tongs device 12 is schematically illustrated to represent any powered tool, wrench or mechanism known for assembling or disassembling the series of elongate members 14 by respectively screwing or unscrewing the threaded joints interconnecting the series of elongate members 14. Depending on the type of elongate member and interconnecting joints, conventional tongs 12 are such that tongs 12 include suitable jaws for engaging one or more elongate members and, in some examples, for also engaging a coupling interconnecting two elongate members. In the illustrated example, tongs device 12 is connected to a powered actuator 18 (e.g., a robotic arm, linkage, track, etc.) for automatically deploying and retracting tongs device 12 relative to a targeted threaded joint. In some examples tongs device 12 is an open-face set of tongs, wherein deployment and retraction of tongs device 12 involves moving tongs device 12 horizontally (e.g., arrows 13 of FIG. 2) to and from the targeted threaded joint. In some examples, tongs device 12 is a closed-face set of tongs, wherein deployment and retraction of tongs device 12 involves moving tongs device 12 vertically to and from the targeted threaded joint (e.g., arrows 15 of FIG. 6).

In the illustrated example, the series of elongate members 14 comprises a first set of elongate members 20, a second set of elongate members 22, and any number of additional sets of elongate members. The term, "set" refers to an assembled group of elements. In this example, the first set of elongate members 20 comprises a first plurality of elongate members 24 interconnected by a first plurality of joints 26, and the second set of elongate members 22 comprises a second plurality of elongate members 28 interconnected by a second plurality of joints 30. The first plurality of joints 26 includes a first lowermost joint 32 that connects the first set of elongate members 20 to the second set of elongate members 22. In some examples, the second plurality of joints 30 includes a second lowermost joint 34 that connects the second set of elongate members 22 to one or more additional sets of elongate members.

The term, "joint" refers to any threaded connection. Examples of joints 26, 30, 32 and 34 include, but are not limited to, two rods with male threaded ends screwed into a female threaded coupling; two pipes with male threaded ends screwed into a female threaded coupling; two rods each with male threads at one end and female threads at an opposite end, wherein one rod is screwed directly into the other one without a coupling between the two; and two pipes each with male threads at one end and female threads at an opposite end, wherein one pipe is screwed directly into the other one without a coupling between the two.

Additional elements useful in the currently described method for operating lifting device 10 and tongs device 12 include one or more conventional known elevator connectors 36 (e.g., clevis with a bail adapted to capture a joint, coupling, and/or shoulder of an elongate member), a computer 38, a joint sensor 40, a conventional known holding device 42 (e.g., a pneumatic slip), and a predetermined storage area 44 (e.g., a rack for holding one or more elongate members). Elevator connectors 36 are well known devices used for connecting a hook 46 of lifting device 10 to an upper end of an elongate member (e.g., members 24, 28, etc.) and/or a coupling attached thereto. In some examples, elevator connector 36 is also selectively used at the surface of a work platform 48 to engage the series of elongate members 14 to prevent them from falling back down into wellbore 16 when lifting device 10 disengages the upper end of the series of elongate members 14. Additionally and/or alternatively, holding device 42 can be used at the surface of work platform 48 to engage the series of elongate members 14 to prevent them from falling back down into wellbore 16 when lifting device 10 disengages the upper end of the series of elongate members 14.

The term, "computer" refers to any electronic controller or collection of controllers comprising one or more circuits. Examples of computer 38 include, but are not limited to, a microprocessor-based electric circuit, a programmable logic controller (PLC), a programmable circuit, a non-programmable circuit, a desktop computer, laptop computer, personal computer, industrial computer, microcomputer, IC based electric circuit (electric circuit with an integrated circuit chip), Internet/web based software, and various combinations thereof. In some examples, computer 38 provides a plurality of outputs (examples of which include, but are not limited to outputs 50, 52, 54 and 56) in response to a plurality of inputs (examples of which include, but are not limited to, inputs 58 and signal 60).

Joint sensor 40 is schematically illustrated to represent any means for sensing the presence of a joint and generating an electric signal 60 in response to sensing the presence of the joint. In some examples, joint sensor 40 is a non-contact proximity sensor (e.g., Hall Effect, optical detection, ultrasonic detection, laser, etc.), that generates signal 60 upon sensing the proximity of an enlarged-diameter section of the series of elongate members 14, wherein such an enlarged-diameter section is evidence of a joint.

Holding device 42 is schematically illustrated to represent any means for gripping or clamping a portion of the series of elongate members 14 or otherwise holding or maintaining the series of elongate members 14 at a desired elevation. In some examples, holding device 42 comprises one or more wedges that are pneumatically actuated to bind radially against an elongate member. In other examples, holding device 42 comprises one or more hydraulic cylinders that selectively extend and retract in a radial direction relative to an elongate member. In still other examples, a releasable second elevator connector 36 (or an equivalent thereof) at the surface of work platform 48 serves as such a holding device. Holding device 42 is shown in a holding position in FIGS. 2, 5-8, and 11-13 and is shown in a release position in FIGS. 3, 4, 9, 10 and 14.

Figure 2:
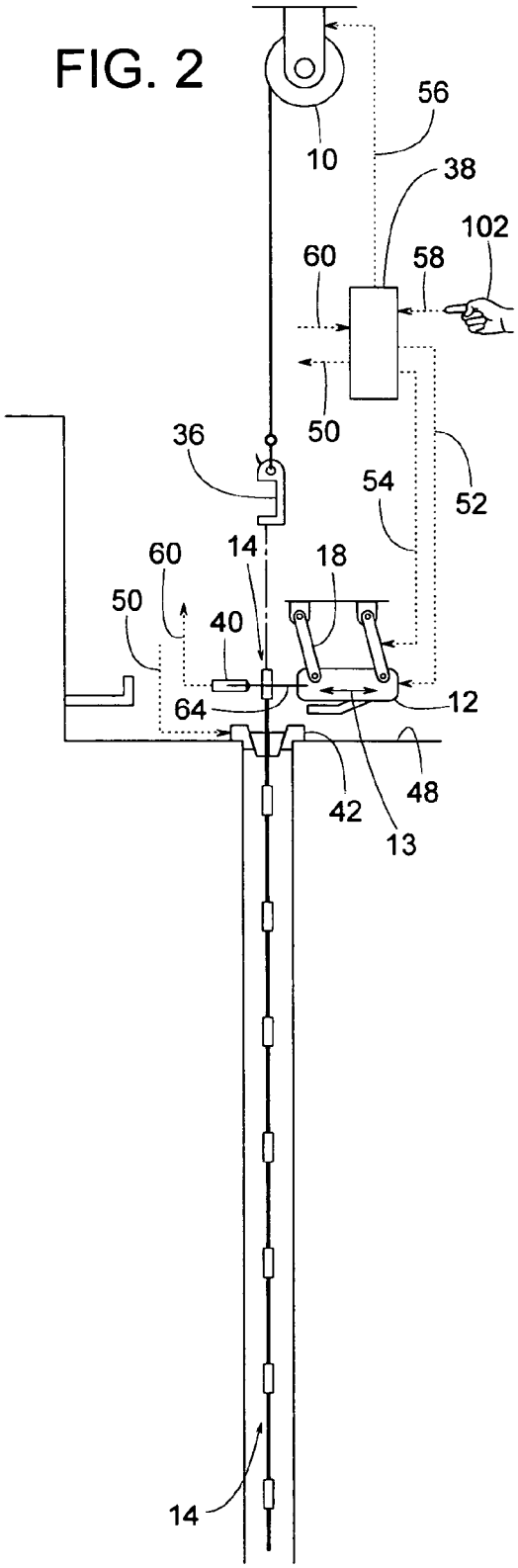
FIG. 2 is a schematic side view similar to FIG. 1 but showing an example lifting device approaching an example series of elongate members.
Figure 12:
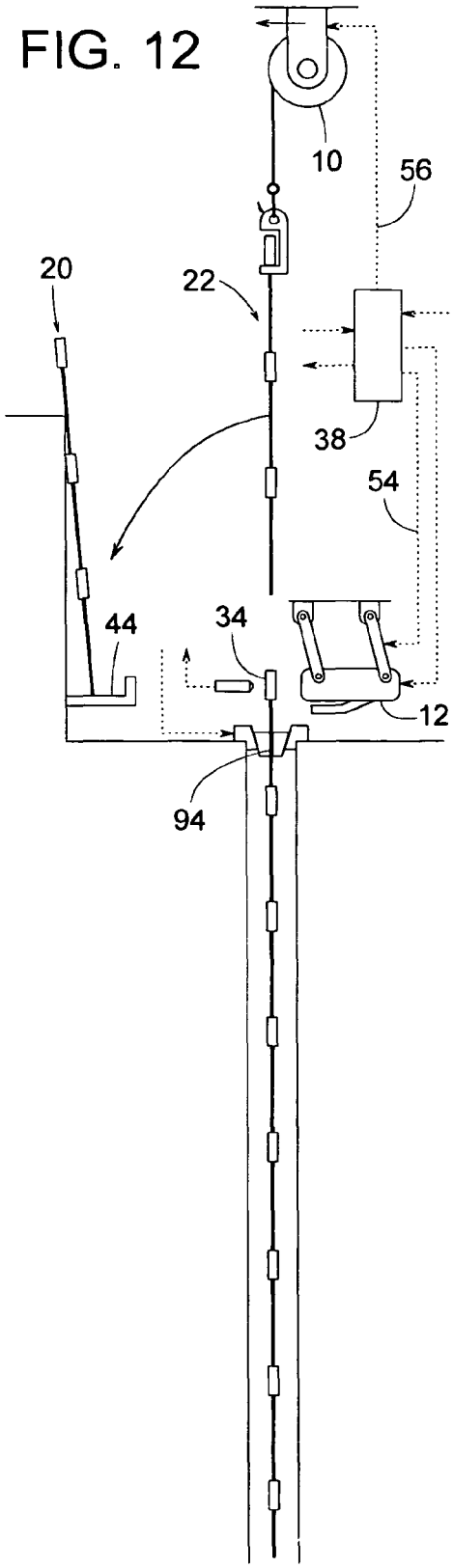
FIG. 12 is a schematic side view similar to FIG. 7 but showing the lifting device transferring a second set of elongate members to the storage rack.
Figure 13:
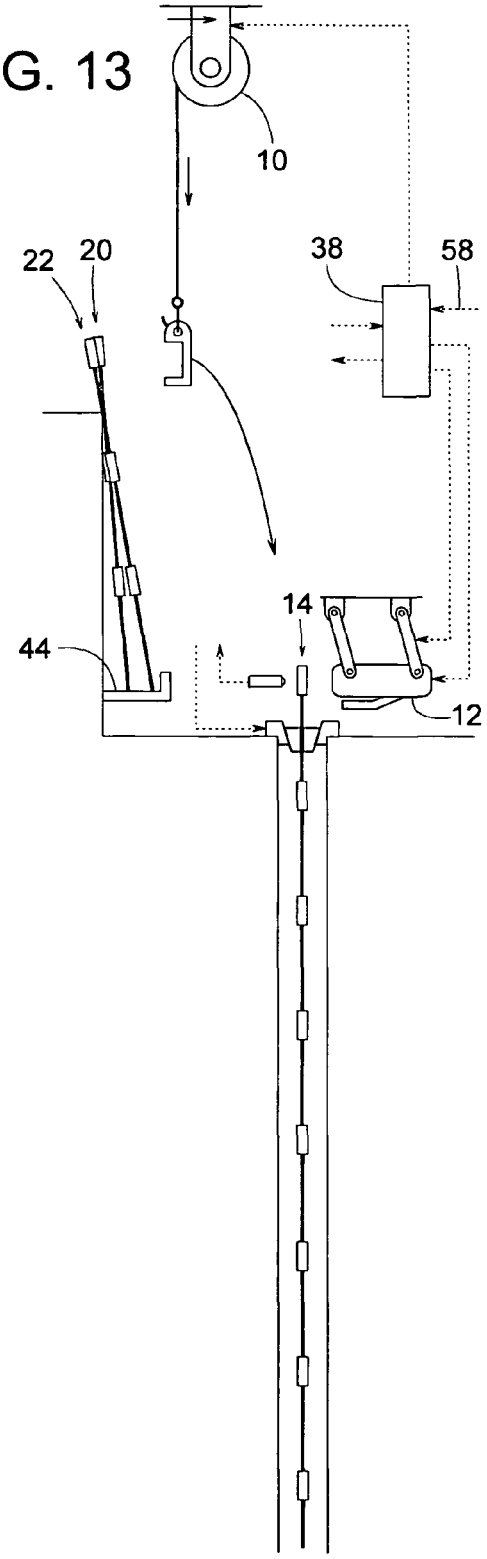
FIG. 13 is a schematic side view similar to FIG. 8 but showing the lifting device approaching yet another set of elongate members for removal.
Figure 14:
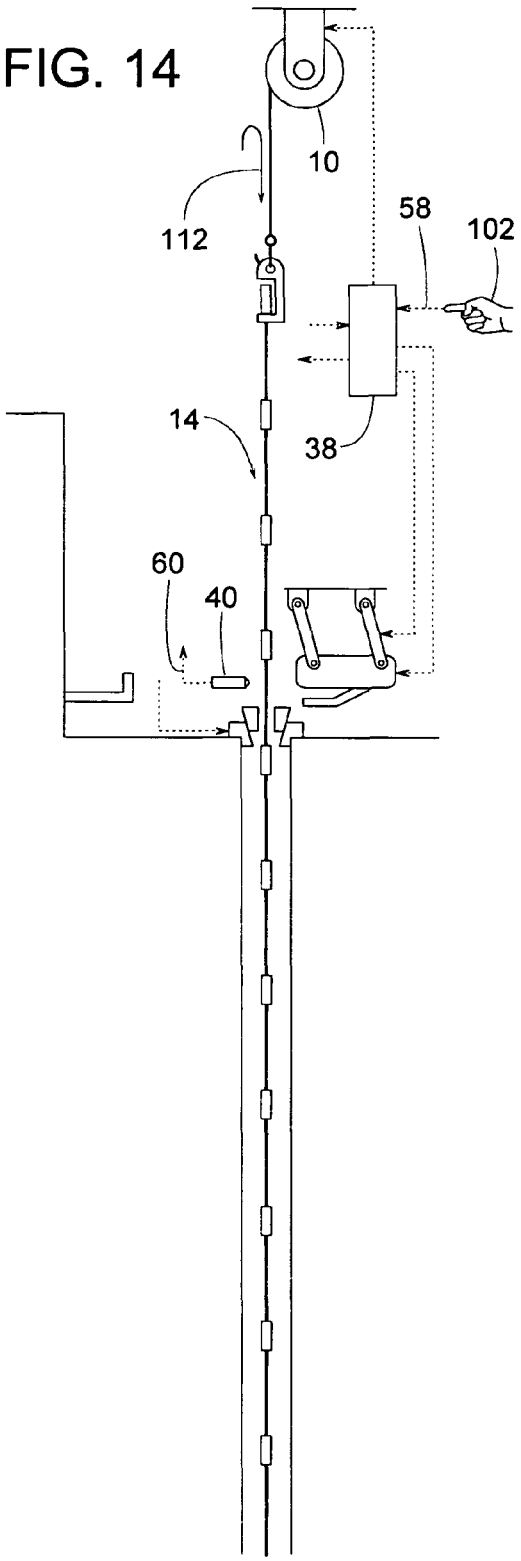
FIG. 14 is a schematic side view similar to FIG. 10 but showing the lifting device reversing direction in response to a joint having overshot the target elevation.
Figure 15:
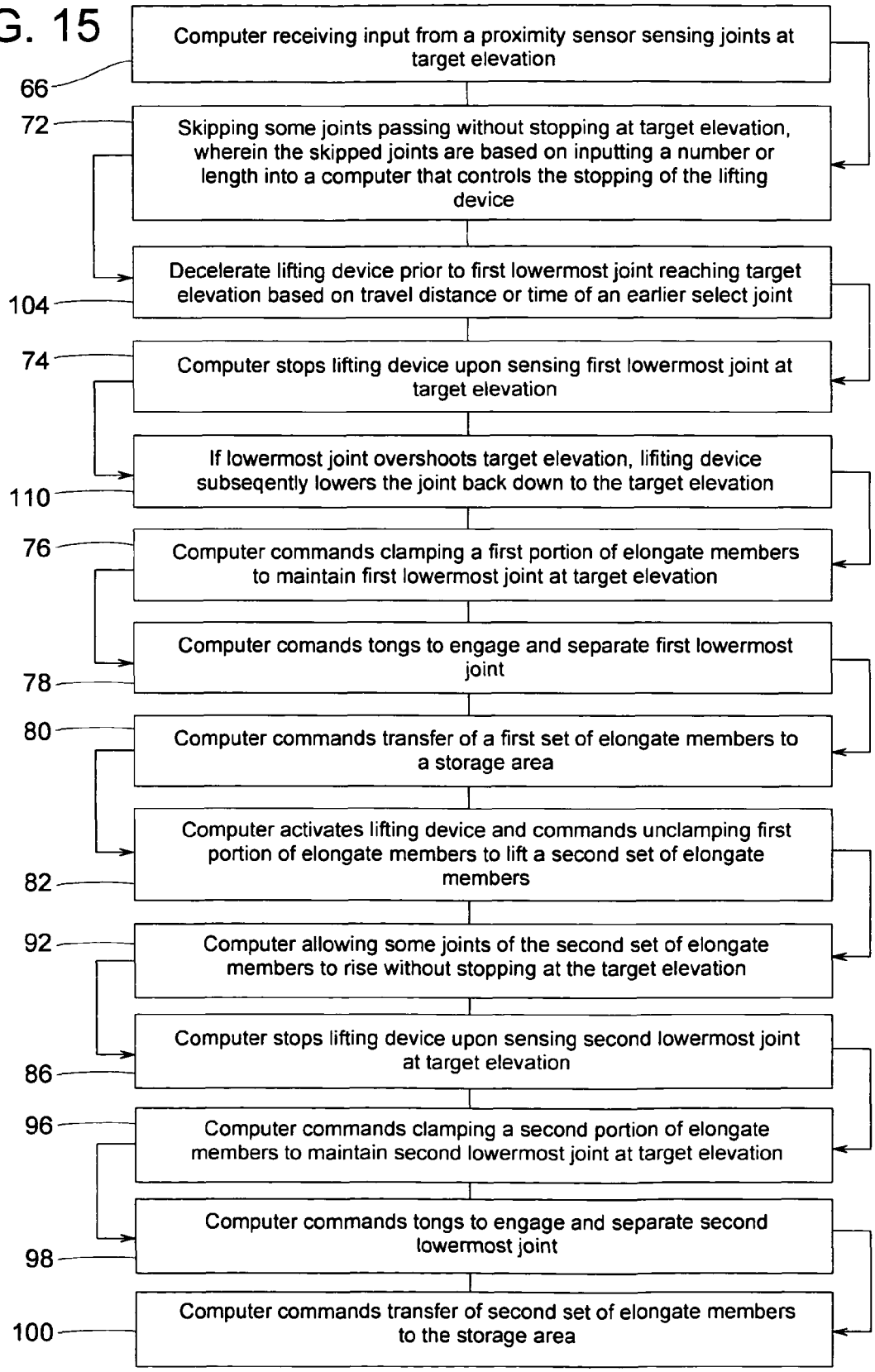
FIG. 15 is an algorithm illustrating various method operations including, but not limited to, functions performed and/or controlled automatically by a computer.

In some examples, the method of operation follows the sequence illustrated by FIGS. 2-13 and, in some cases, with further reference to FIGS. 14 and 15. FIG. 2 shows device 42 gripping the series of elongate members 14 to maintain the series of elongate members 14 at a fixed elevation at least momentarily. Lifting device 10 lowers elevator connector 36 into engagement with the upper end of the series of elongate members 14.

Figure 3:
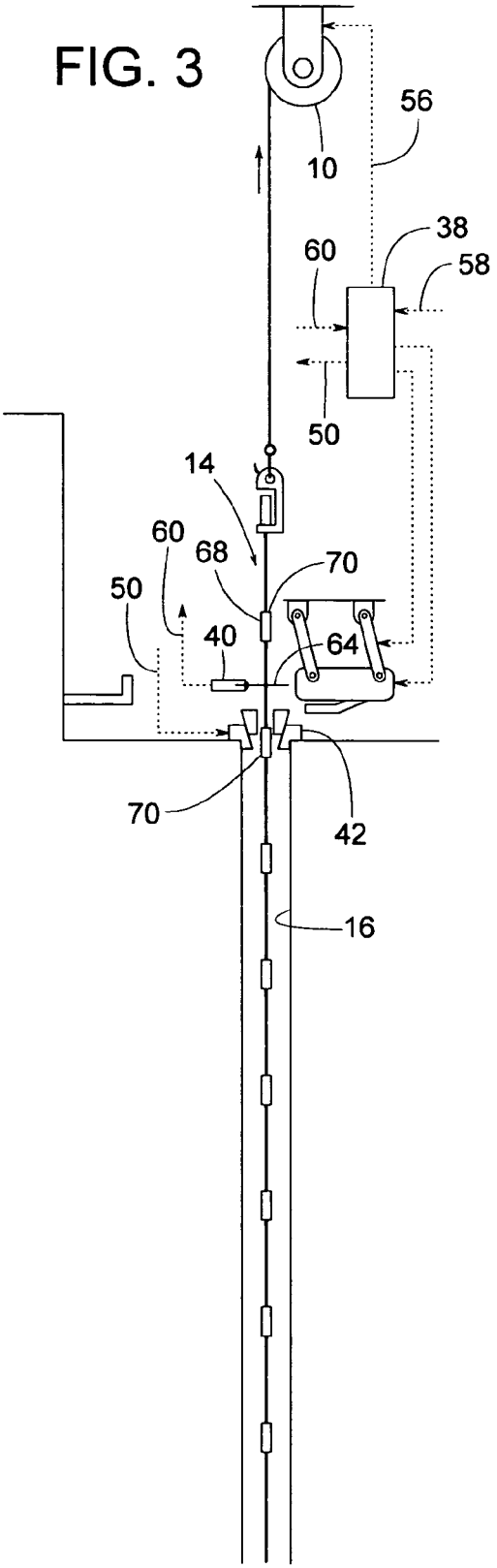
FIG. 3 is a schematic side view similar to FIG. 2 but showing the lifting device lifting the series of elongate members.
Figure 4:
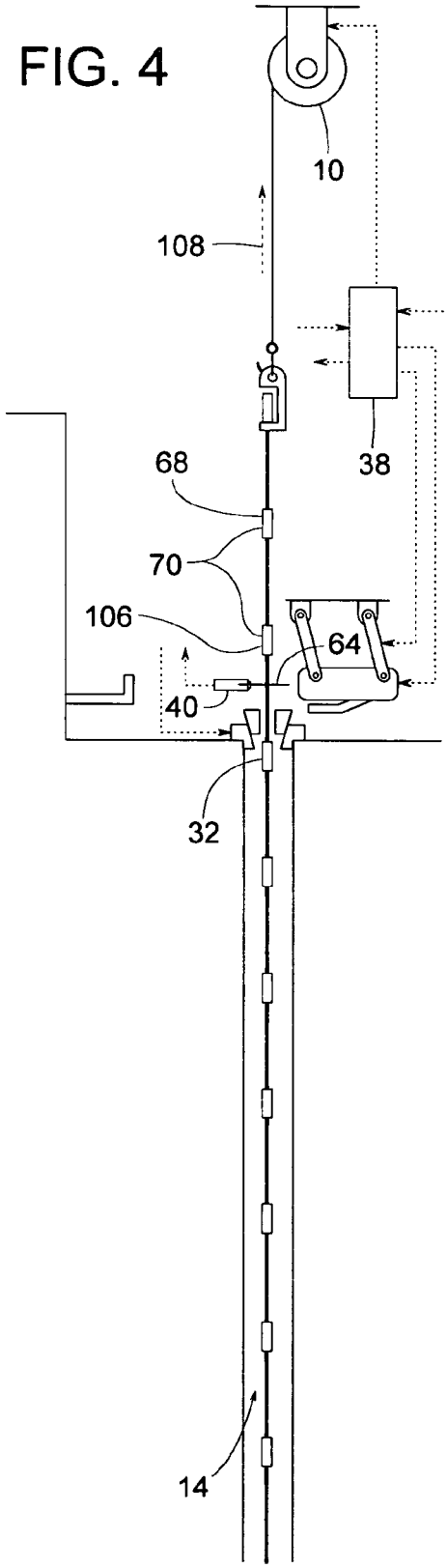
FIG. 4 is a schematic side view showing some joints being skipped and showing upward deceleration of the lifting device.

In FIGS. 3 and 4, via output 50, computer 38 commands holding device 42 to release the series of elongate member 14. Via output 56, computer 38 commands lifting device 10 to lift the series of elongate members 14 up from within wellbore 16. Upon doing so, joint sensor 40 sequentially senses joints 26 and 30 as those joints sequentially reach a target elevation 64. Joint sensor 40 provides computer 38 with an input (e.g., electric signal 60) indicating when each joint reaches target elevation 64 (a block 66 of FIG. 15). In some examples, computer 38 allows one or more joints (e.g., a first skipped joint 68 or a first plurality of skipped joints 70) to rise past target elevation 64 without joint 68 stopping at target elevation 64 (block 72 of FIG. 15). In some examples, target elevation 64 is a certain zone or predefined range of elevations rather than a precise point.

Figure 5:
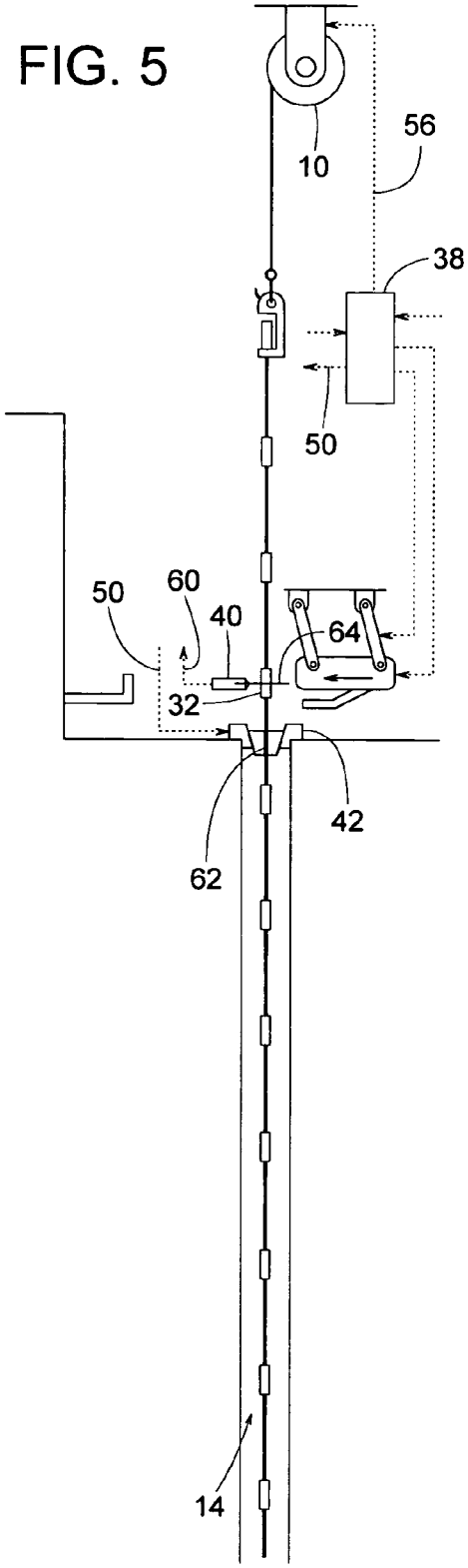
FIG. 5 is a schematic side view similar to FIGS. 1-4 but showing a selected joint momentarily stopped at a target elevation.

In FIG. 5, via output 56, computer 38 commands lifting device 10 to stop lifting (block 74 of FIG. 15) in response to computer 38 determining (based in part on signal 60 from sensor 40) that the first lowermost joint 32 has reached target elevation 64. Via output 50, computer 38 commands holding device 42 to clamp, grip, engage or hold first portion 62 of the series of elongate members 144 (block 76 of FIG. 15) to maintain the first lowermost joint 32 of the first set of elongate members 20 (FIG. 1) at target elevation 64 to allow sufficient time to perform unscrewing and/or other operations.

Figure 6:
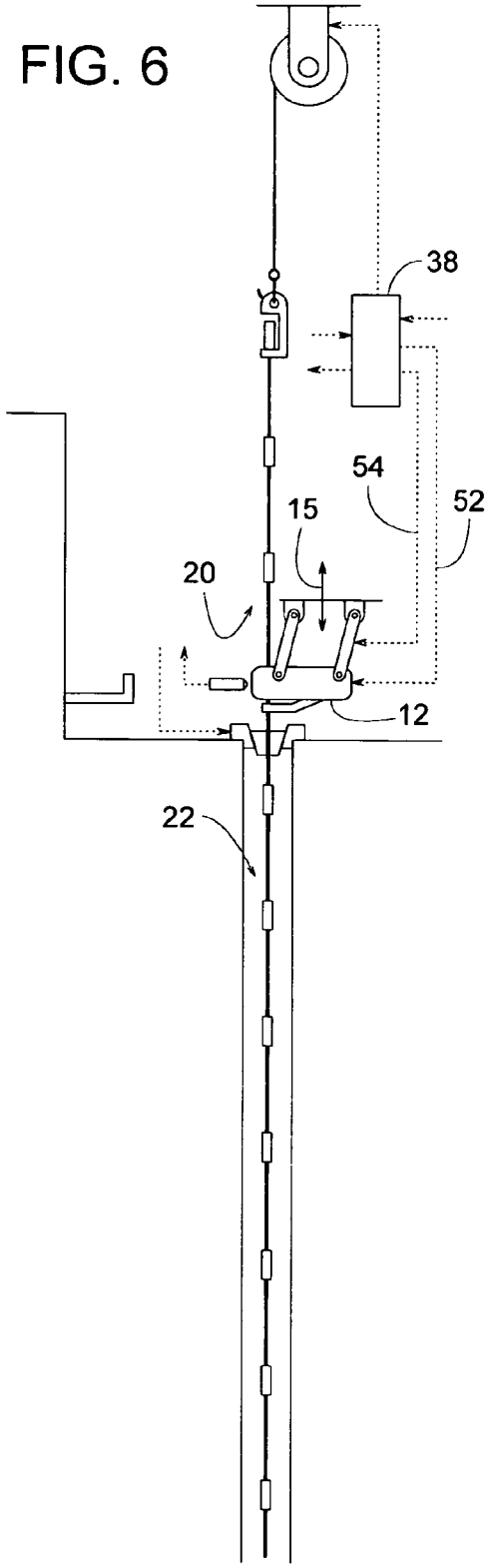
FIG. 6 is a schematic side view similar to FIG. 5 but showing an example tongs device unscrewing the selected joint.

Referring also to FIG. 6, while the first lowermost joint 32 (FIG. 5) is held momentarily (e.g., several seconds) at target elevation 64, computer 38 via output 54 commands deployment of tongs device 12 and then via output 52 commands tongs device 12 to unscrew joint 32 (FIG. 5), thereby separating the first set of elongate members 20 from the second set of elongate members 22 (block 78 of FIG. 15). In cases where joint 32 includes a coupling between two elongate members, the coupling, upon separation of the joint, may stay with the upper elongate member, stay with the lower elongate member, or be separated from both elongate members.

Figure 7:
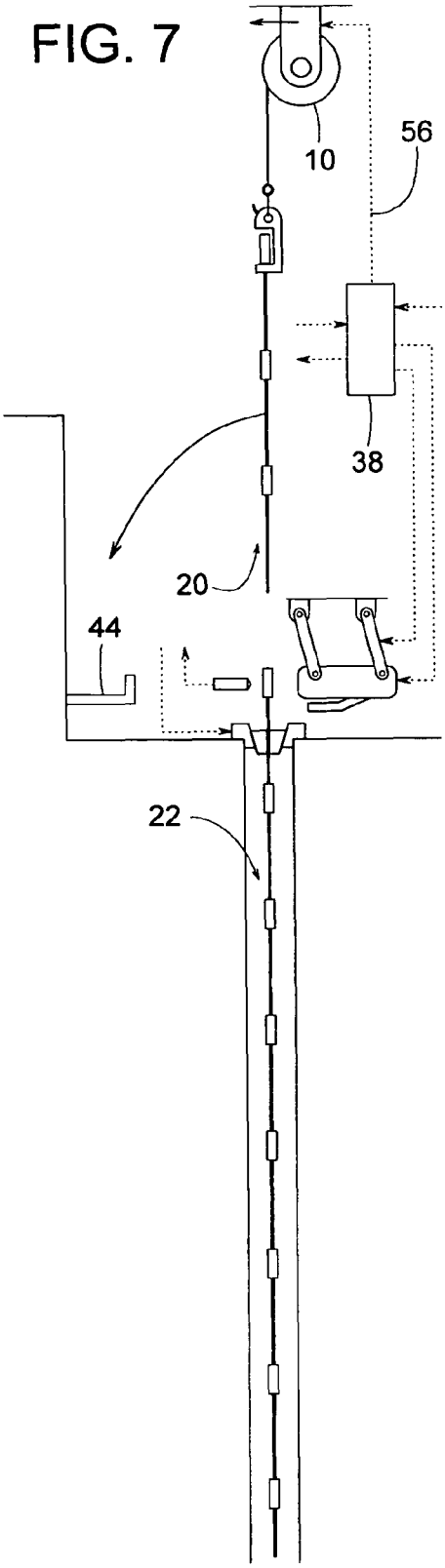
FIG. 7 is a schematic side view similar to FIG. 6 but showing the lifting device transferring a first set of elongate members to a storage rack.

FIG. 7 shows computer 38 commanding, via output 56, lifting device 10 to transfer the first set of elongate member 20 as an assembled first unit to storage area 44 (block 80 of FIG. 15).

Figure 8:
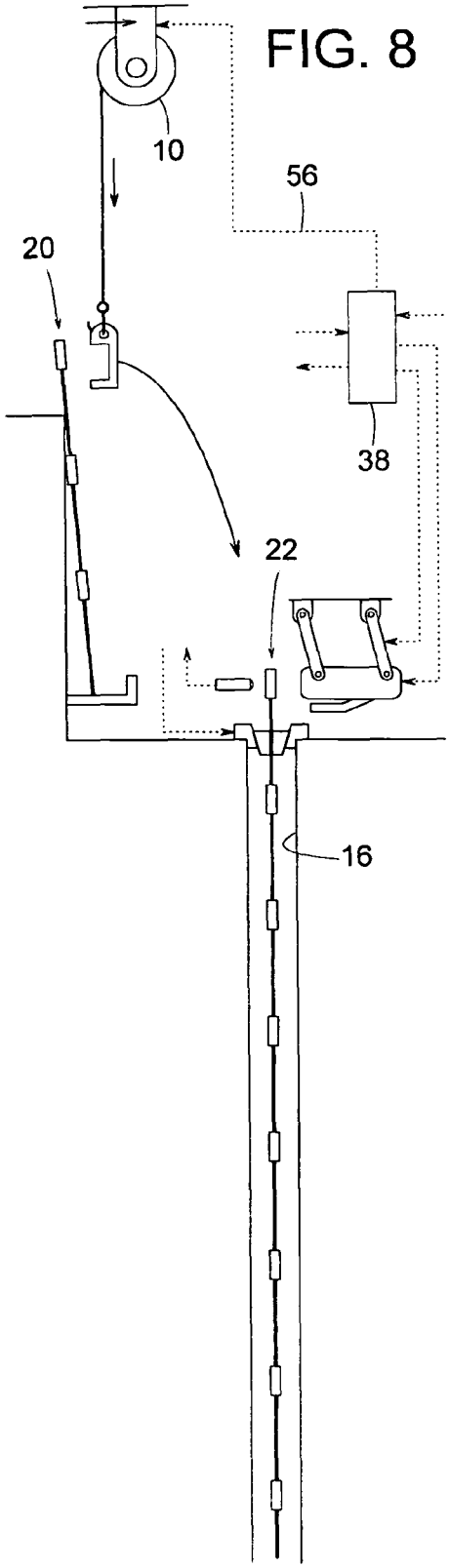
FIG. 8 is a schematic side view similar to FIG. 7 but showing the lifting device approaching a second set of elongate members for removal.
Figure 9:
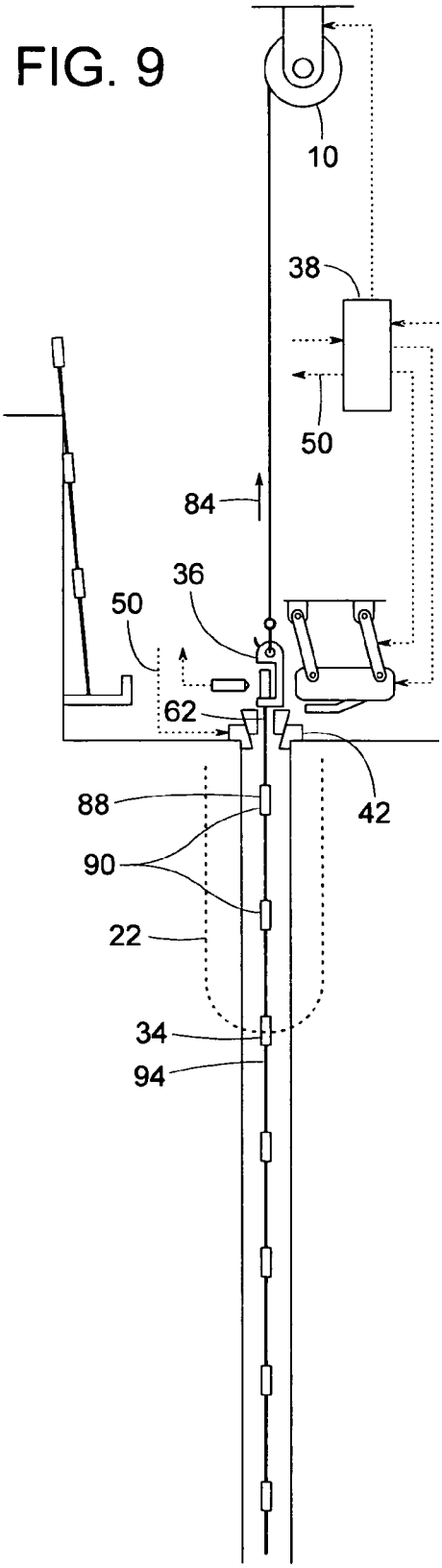
FIG. 9 is a schematic side view similar to FIG. 3 but showing the lifting device working to remove the second set of elongate members.
Figure 10:
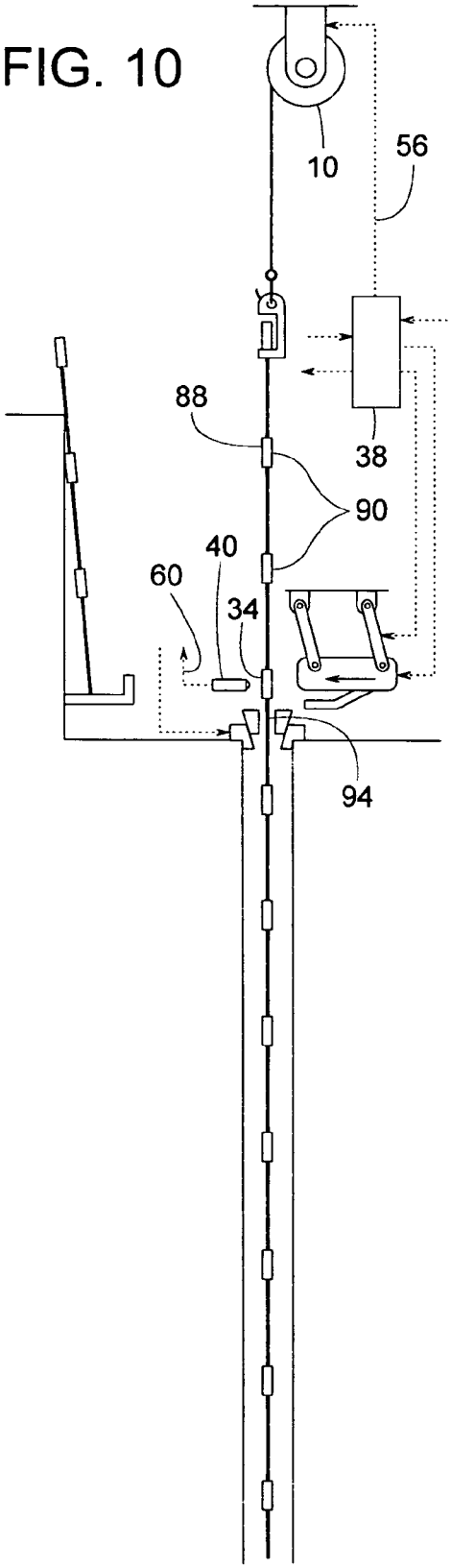
FIG. 10 is a schematic side view similar to FIG. 4 but showing the lifting device working to remove the second set of elongate members.

FIGS. 8-10 show computer 38, via output 56, activating lifting device 10 to engage and lift the second set of elongate members 22 up from within wellbore 16. FIG. 9 shows elevator connector 36 of lifting device 10 engaging the upper end of the second set of elongate members 22. FIG. 9 also shows computer 38, via output 50, commanding holding device 42 to release (e.g., unclamp) portion 62 of the series of elongate members 22 (block 82 of FIG. 15). Arrow 84 of FIG. 9 represents lifting device 10 lifting the second set of elongate members 22. FIG. 10 shows computer 38 commanding, via output 56, lifting device 10 to stop lifting in response to computer 38 determining (based in part on signal 60 from sensor 40) that the second lowermost joint 34 has reached target elevation 64 (block 86 of FIG. 15). As lifting device 10 lifts the second set of elongate members 22 from the position of FIG. 9 to that of FIG. 10, computer 38 allows one or more joints (e.g., a second skipped joint 88 or a second plurality of skipped joints 90) to rise past target elevation 64 without joint 88 stopping at target elevation 64 (block 92 of FIG. 15).

Figure 11:
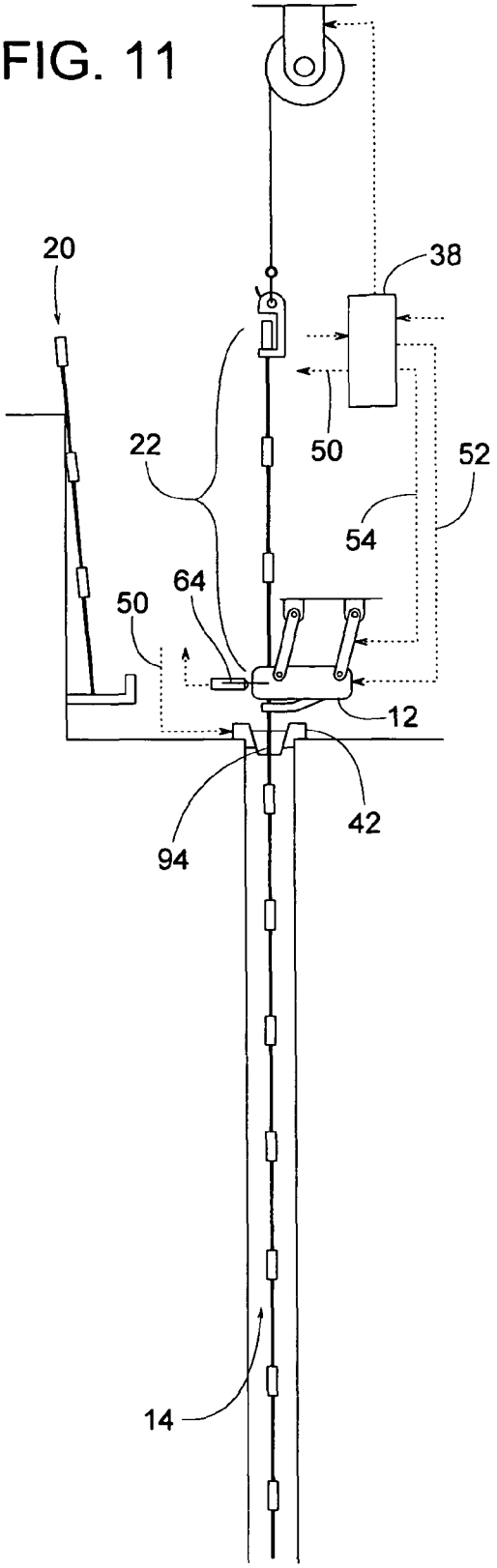
FIG. 11 is a schematic side view similar to FIG. 6 but showing the tongs device unscrewing another selected joint.

Referring to FIG. 11, computer 38 via output 50 commands holding device 42 to clamp, grip, engage or hold a second portion 94 of the series of elongate members 14 to maintain, at least momentarily, the second lowermost joint 34 of the second set of elongate members 22 at target elevation 64 (block 96 of FIG. 15). While the second lowermost joint 34 is held at target elevation 64, computer 38 via output 54 commands deployment of tongs device 12 and then via output 52 commands tongs device 12 to unscrew joint 34, thereby separating the second set of elongate members 22 from the remainder of the series of elongate members (block 98 of FIG. 15).

FIG. 12 shows computer 38 commanding, via output 56, lifting device 10 to transfer the second set of elongate member 22 as an assembled second unit to storage area 44 (block 100 of FIG. 15). FIG. 13 shows the process of FIGS. 8-12 generally repeating as just described but with the purpose of removing additional sets of elongate members from the series of elongate members 14.

A challenging problem with the aforementioned process is being able to efficiently and quickly withdraw assembled sets of elongate members. To do so, lifting device 10 needs to lift the series of elongate members 14 as rapidly as possible. This can be difficult because computer 38 needs to quickly determine which joints are to be skipped (e.g., a first plurality of skipped joints 70, a second plurality of skipped joints 90, etc.) and which ones need to be disconnected (e.g., first lowermost joint 32, second lowermost joint 34, etc.).

To this end, in some examples, a user 102 (FIG. 2) enters into computer 38 an input 58 that provides some indication as to a certain number of joints that are to be skipped in each set of elongate members 20 or 22 and/or a predetermined approximate length (e.g., a nominal length) of each set of elongate members 20 or 22. In the example where input 58 is a certain number of skipped joints per set, computer 38 counts signals 60 from sensor 40 and compares the count to determine when a joint to be disconnected arrives at target elevation 64.

In the example where input 58 is a length input (e.g., the maximum or overall length of the first set of elongate members 20), computer 38 compares the length input to the lifting device's actual hook travel distance based on feedback from, for example, an encoder connected to lifting device 10 and uses the comparison to determine when the next joint to be disconnected arrives at target elevation 64. In cases where lifting device 10 does not employ an encoder or other means for sensing the hook's position or travel distance, a timer is used to measure the period between sequential joints passing sensor 40, and that information in combination with a known length of an individual elongate member 26 is used by computer 38 to determine when sufficient time has elapsed for a lowermost joint (e.g., joint 32 or 34, etc.) to reach target elevation 64. A sufficient elapsed time, for example, would be the period measured by the timer multiplied by the desired number of individual elongate members per each set of elongate members 20 or 22.

Once computer 38 includes one of the aforementioned means for determining which joints are to be skipped and which ones need to be disconnected, computer 38, in some examples, decelerates lifting device 10 just prior to a lowermost joint (e.g., joint 32 or 34) reaching target elevation 64 (block 104 of FIG. 15). Referring back to FIG. 4, in some examples, for instance, when a select joint 106 (e.g., the joint just above first lowermost joint 32 or some other preceding joint) passes sensor 40, computer 38 commands lifting device 10 to continue the lifting process at full speed for a predetermined period or predetermined distance of select joint 106 traveling beyond target elevation 64 before decelerating lifting device 10 in anticipation of the next arriving lowermost joint (e.g., joint 32) at target elevation 64. Dashed arrow 108 of FIG. 4 illustrates the step of decelerating.

Referring to FIG. 14, in the event that a target joint (e.g., lowermost joint 32 or 34) overshoots target elevation 64 as a result of lifting device 10 accidentally lifting the target joint above target elevation 64, computer 38 subsequently commands lifting device 10 to lower the series of elongate members 14 until the target joint is back down to the target elevation (block 110 of FIG. 15). Arrow 112 of FIG. 14 represents lifting device 10 reversing direction and subsequently lowering the series of elongate members 14.

Although the invention is described with respect to a preferred embodiment, modifications thereto will be apparent to those of ordinary skill in the art. The aforementioned methods, for example, can readily be reversed to assemble and install a series of elongate members. The scope of the invention, therefore, is to be determined by reference to the following claims:

The invention claimed is:

1. A method for controlling a lifting device and a tongs device in handling a series of elongate members associated with a wellbore, the series of elongate members includes a first set of elongate members and a second set of elongate members, the first set of elongate members includes a first plurality of elongate members interconnected via a first plurality of joints, the second set of elongate members includes a second plurality of elongate members interconnected via a second plurality of joints, the first plurality of joints includes a first skipped joint and a first lowermost joint, the first lowermost joint connects the first set of elongate members to the second set of elongate members, the second plurality of joints includes a second skipped joint and a second lowermost joint, the method comprising:

selectively activating and stopping the lifting device, which is configured to lift the series of elongate members up from within the wellbore;

selectively lifting the series of elongate members;

as the lifting device lifts the series of elongate members, sequentially sensing the first plurality of joints and the second plurality of joints as the first plurality of joints and the second plurality of joints sequentially reach a target elevation;

allowing the first skipped joint of the first plurality of joints to rise past the target elevation without the first skipped joint stopping at the target elevation;

generating an electric signal in response to sensing the first lowermost joint is at the target elevation;

stopping the lifting device in response to the electric signal thus stopping the lifting device when the first lowermost joint is at the target elevation;

clamping a first portion of the series of elongate members to maintain the first lowermost joint at the target elevation;

deploying the tongs device to separate the first lowermost joint, thereby separating the first set of elongate members from the second set of elongate members;

transferring the first set of elongate members as a first unit to a predetermined storage area;

activating the lifting device and unclamping the first portion of the series of elongate members to lift the second set of elongate members up from within the wellbore;

allowing the second skipped joint of the second plurality of joints to rise past the target elevation without the second skipped joint stopping at the target elevation;

generating the electric signal in response to sensing the second lowermost joint is at the target elevation;

stopping the lifting device in response to the electric signal thus stopping the lifting device when the second lowermost joint is at the target elevation;

clamping a second portion of the series of elongate members to maintain the second lowermost joint at the target elevation;

deploying the tongs device to separate the second lowermost joint, thereby separating the second set of elongate members from the second portion of elongate members; and transferring the second set of elongate members as a second unit to the predetermined storage area.

2. The method of claim 1, wherein deploying the tongs device to separate the first lowermost joint is automatically initiated via a computer in response to completing both steps of: a) stopping the lifting device in response to sensing the first lowermost joint is at the target elevation and b) clamping the first portion of the series of elongate members to maintain the first lowermost joint at the target elevation.

3. The method of claim 1, further comprising decelerating the lifting device prior to the first lowermost joint reaching the target elevation.

4. The method of claim 3, wherein the step of decelerating the lifting device is initiated when a select joint of the first plurality of joints has traveled a predetermined distance above the target elevation.

5. The method of claim 3, wherein the step of decelerating the lifting device is initiated when a select joint of the first plurality of joints has traveled a predetermined period after reaching the target elevation.

6. The method of claim 1, wherein the first plurality of joints includes a first plurality of skipped joints of a predetermined number, the first skipped joint is one of the first plurality of skipped joints, and further comprising:

entering an input into a computer, wherein the predetermined number is a function of the input;

the computer controlling the selectively activating and stopping the lifting device;

the computer considering the input in controlling the selectively activating and stopping the lifting device; and the computer allowing the first plurality of skipped joints to rise past the target elevation without stopping the lifting device at any of the first plurality of skipped joints.

7. The method of claim 6, wherein the second plurality of joints includes a second plurality of skipped joints also of the predetermined number, the second skipped joint is one of the second plurality of skipped joints, and further comprising allowing the second plurality of skipped joints to rise past the target elevation without stopping the lifting device at any of the second plurality of skipped joints.

8. The method of claim 1, wherein the first plurality of joints includes a first plurality of skipped joints of a certain number, the first skipped joint is one of the first plurality of skipped joints, and further comprising:

entering a length input into a computer;

the computer deriving the certain number based on the length input;

the computer controlling the selectively activating and stopping the lifting device;

the computer considering at least one of the length input and the certain number in controlling the selectively activating and stopping the lifting device; and the computer allowing the first plurality of skipped joints to rise past the target elevation without stopping the lifting device at any of the first plurality of skipped joints.

9. The method of claim 1, wherein the series of elongate members includes a target joint and further comprising lifting the series of elongate members up from within the wellbore until the target joint rises above the target elevation and subsequently lowering the series of elongate members until the target joint is at the target elevation.

10. The method of claim 1, wherein deploying the tongs device involves moving the tongs device horizontally.

11. The method of claim 1, wherein deploying the tongs device involves moving the tongs device vertically.

12. A method for using a computer in coordinating the operation of a lifting device and a tongs device in handling a series of elongate members associated with a wellbore, the series of elongate members includes a first set of elongate members and a second set of elongate members, the first set of elongate members includes a first plurality of elongate members interconnected via a first plurality of joints, the second set of elongate members includes a second plurality of elongate members interconnected via a second plurality of joints, the first plurality of joints includes a first skipped joint and a first lowermost joint, the first lowermost joint connects the first set of elongate members to the second set of elongate members, the second plurality of joints includes a second skipped joint and a second lowermost joint, the method comprising:

the computer selectively commanding activating and stopping the lifting device, wherein the lifting device is configured to lift the series of elongate members up from within the wellbore;

the lifting device selectively lifting the series of elongate members;

as the lifting device lifts the series of elongate members, a joint sensor sequentially sensing the first plurality of joints and the second plurality of joints as the first plurality of joints and the second plurality of joints sequentially reach a target elevation;

the computer allowing the first skipped joint of the first plurality of joints to rise past the target elevation without the first skipped joint stopping at the target elevation;

the computer commanding stopping the lifting device in response to the joint sensor sensing the first lowermost joint is at the target elevation;

the lifting device stopping the first lowermost joint at the target elevation;

the computer commanding clamping a first portion of the series of elongate members to maintain the first lowermost joint at the target elevation;

maintaining at least momentarily the first lowermost joint at the target elevation;

the computer commanding deployment of the tongs device to separate the first lowermost joint;

deploying the tongs device, thereby separating the first set of elongate members from the second set of elongate members;

the computer commanding transfer of the first set of elongate members to a predetermined storage area;

transferring the first set of elongate members as a first unit to the predetermined storage area;

activating the lifting device to lift the second set of elongate members up from within the wellbore;

the computer allowing the second skipped joint of the second plurality of joints to rise past the target elevation without the second skipped joint stopping at the target elevation;

the computer commanding stopping the lifting device in response to the joint sensor sensing the second lowermost joint is at the target elevation;

stopping the lifting device in response to the joint sensor sensing the second lowermost joint is at the target elevation;

the computer at least momentarily maintaining the second lowermost joint at the target elevation;

the computer commanding deployment of the tongs device to separate the second lowermost joint;

deploying the tongs device, thereby separating the second set of elongate members from the second portion of elongate members;

the computer commanding transfer of the second set of elongate members to the predetermined storage area; and transferring the second set of elongate members as a second unit to the predetermined storage area.

13. The method of claim 12, wherein deploying the tongs device to separate the first lowermost joint is automatically initiated via the computer in response to completing both steps of: a) stopping the lifting device in response to the joint sensor sensing the first lowermost joint is at the target elevation and b) maintaining the first lowermost joint at the target elevation at least momentarily.

14. The method of claim 12, further comprising decelerating the lifting device prior to the first lowermost joint reaching the target elevation.

15. The method of claim 14, wherein the step of decelerating the lifting device is initiated when a select joint of the first plurality of joints has traveled a predetermined distance above the target elevation.

16. The method of claim 14, wherein the step of decelerating the lifting device is initiated when a select joint of the first plurality of joints has traveled a predetermined period after reaching the target elevation.

17. The method of claim 12, wherein the first plurality of joints includes a first plurality of skipped joints of a predetermined number, the first skipped joint is one of the first plurality of skipped joints, and further comprising:

entering an input into the computer, wherein the predetermined number is a function of the input;

the computer considering the input in selectively commanding activating and stopping the lifting device; and the computer allowing the first plurality of skipped joints to rise past the target elevation without stopping the lifting device at any of the first plurality of skipped joints.

18. The method of claim 17, wherein the second plurality of joints includes a second plurality of skipped joints also of the predetermined number, the second skipped joint is one of the second plurality of skipped joints, and further comprising allowing the second plurality of skipped joints to rise past the target elevation without stopping the lifting device at any of the second plurality of skipped joints.

19. The method of claim 12, wherein the first plurality of joints includes a first plurality of skipped joints of a certain number, the first skipped joint is one of the first plurality of skipped joints, and further comprising:

entering a length input into the computer;

the computer deriving the certain number based on the length input;

the computer considering at least one of the length input and the certain number in selectively commanding activating and stopping the lifting device; and the computer allowing the first plurality of skipped joints to rise past the target elevation without any of the first plurality of skipped joints stopping at the target elevation.

20. The method of claim 12, wherein the series of elongate members includes a target joint and further comprising lifting the series of elongate members up from within the wellbore until the target joint rises above the target elevation and subsequently lowering the series of elongate members until the target joint is at the target elevation.

* * * * *